United States Patent [19]

Balakrishnan et al.

[11] Patent Number: 4,903,528

[45] Date of Patent: Feb. 27, 1990

[54] SYSTEM AND PROCESS FOR DETECTING PROPERTIES OF TRAVELLING SHEETS IN THE CROSS DIRECTION

[75] Inventors: Ramesh Balakrishnan, Stanford; Gurcan Aral, Cupertino, both of Calif.

[73] Assignee: Measurex Corporation, Cupertino, Calif.

[21] Appl. No.: 249,617

[22] Filed: Sep. 26, 1988

[51] Int. Cl.[4] ..... G01N 33/34; G01N 33/44

[52] U.S. Cl. ..... 73/159; 356/431; 250/563; 364/568; 364/471; 364/473; 73/73

[58] Field of Search ..... 73/159, 73; 356/429, 356/430, 431, 238; 250/563, 252.1 A; 364/568, 471, 473

[56] References Cited

U.S. PATENT DOCUMENTS

| | | | |
|---|---|---|---|
| 2,909,660 | 10/1959 | Alexander | 73/159 |
| 3,000,438 | 9/1961 | Alexander | 73/159 |
| 3,332,279 | 7/1967 | Tompos et al. | 73/159 |
| 3,508,035 | 4/1970 | Worthley | 364/568 |
| 3,536,258 | 10/1970 | Rocheleau | 364/568 |
| 3,552,203 | 1/1971 | Freeh | 73/159 |
| 3,562,500 | 2/1971 | Grant | 364/568 |
| 3,610,899 | 10/1971 | Dahlin | 364/568 |
| 3,612,839 | 10/1971 | DeWitt | 73/73 |
| 3,666,621 | 5/1972 | Adams | 364/568 |
| 3,687,802 | 8/1972 | Rummel et al. | 364/568 |
| 3,769,829 | 11/1973 | Fleming, Jr. et al. | 73/159 |
| 3,840,302 | 8/1974 | Brunton et al. | 250/563 |
| 3,914,585 | 10/1975 | Wilhelm, Jr. et al. | 73/159 |
| 3,936,665 | 2/1976 | Donoghue | 364/568 |
| 4,000,402 | 12/1976 | Higham | 364/469 |
| 4,453,404 | 6/1984 | Powell et al. | 73/159 |
| 4,476,717 | 10/1984 | Murphy | 73/159 |

*Primary Examiner*—William A. Cuchlinski, Jr.
*Assistant Examiner*—Diego F. F. Gutierrez
*Attorney, Agent, or Firm*—Burns, Doane, Swecker & Mathis

[57] ABSTRACT

To determine measurements such as basis weight and caliper of a travelling sheet during production, the sheet is repeatedly traversed with a scanning sensor and, during each traverse, measurements are taken at a plurality of slice locations. Then, a series of reference locations are selected which are spaced apart in the machine direction along the sheet surface. Then, for selected slices, measurement values are estimated based upon actual measurements taken at locations on the selected slices which are not spaced in the machine direction at the same spacing as reference locations.

20 Claims, 4 Drawing Sheets

MAGNITUDE OF SHEET PROPERTY
a4
b*4
b*3
a3
a2
b*2
b*1
SLICE SL38
CENTER SLICE SL25
SLICE SL12
a4
C4
D4
m4
m3
D3
a3
C3
a2
C2
D2
m2
m1
D1
C1
S4
S3
S2
S1
18
MD
CD

SYSTEM AND PROCESS FOR DETECTING PROPERTIES OF TRAVELLING SHEETS IN THE CROSS DIRECTION

BACKGROUND OF THE INVENTION

1. Field of the Invention

The present invention generally relates to sheetmaking systems and, more particularly, to sheetmaking control systems wherein measuring devices scan across travelling sheets during manufacture.

2. State of the Art

It is well known to make on-line measurements of properties of sheet materials during manufacture. The purpose of on-line measurements, generally speaking, is to enable prompt control of sheetmaking processes and, thus, to enhance sheet quality while reducing the quantity of substandard sheet material which is produced before undesirable process conditions are corrected. In practice, most sheetmaking machines have been instrumented to include-on-line sensors. In the paper-making art, for instance, on-line sensors detect variables such as basis weight, moisture content, and caliper of sheets during manufacture.

On-line measurements during sheetmaking are, however, difficult to make accurately. One factor affecting on-line measurement is that many sheetmaking machines are large and operate at high speeds. For example, some paper-making machines produce sheets up to four hundred inches wide at rates of up to one hundred feet per second. Another factor affecting on-line measurements is that physical properties of sheet materials usually vary across the width of a sheet and may be different in the machine direction than in the cross direction. (In the sheetmaking art, the term "machine direction" refers to the direction of travel of a sheet during manufacture, and the term "cross direction" refers to the direction across the surface of a sheet perpendicular to the machine direction.)

To detect cross-directional variations in sheets, it is well known to use on-line scanning sensors that periodically traverse back and forth across a sheetmaking machine in the cross direction. Normally, measurement information provided by each scanning sensor is assembled to provide, for each scan, a "profile" of the detected property of the sheet. In other words, each profile is comprised of a succession of sheet measurements at adjacent locations extending generally in the cross direction. Based upon the profile measurements, variations are detected in sheet properties in the cross-direction and appropriate controls are adjusted with the goal of providing uniform cross-directional profiles, i.e., profiles that have constant amplitude in the cross direction.

In actual practice, although scanning sensors travel rapidly across sheetmaking machines in the cross direction, consecutive measurement points are not aligned exactly in the true cross direction; that is, the actual points at which scanning sensors provide measurements are not aligned exactly perpendicular to the edge of the sheet being measured. Instead, because of sheet velocity, scanning sensors actually move diagonally across the surface of a travelling sheet with the result that consecutive scanning paths follow a zig-zag pattern. Therefore, profiles based on sheet measurements taken by scanning sensors along the zig-zag paths include some machine-direction variations.

As a result, when consecutive cross-directional profiles are compared or when one location on a profile is compared to another location, machine-direction variations can be confused with cross-directional variation. In the sheetmaking art, such confusion of machine-direction and cross-direction measurements is referred to as MD/CD coupling. As a result of MD/CD coupling, control systems that are intended to control cross-directional variations sometimes introduce artificial control disturbances which worsen, rather than improve, sheet uniformity in the cross direction.

Currently, sheetmaking control systems either do not compensate for MD/CD coupling or employ filters that average errors. Such filtering is not totally satisfactory for several reasons, including the fact that the filtering necessarily entails the loss of otherwise useful measurement information.

SUMMARY OF THE INVENTION

Generally speaking, the present invention provides a method to determine measurements such as basis weight and caliper of a travelling sheet during production. As a preliminary step, a sheet is repeatedly traversed with a scanning sensor and, during each traverse, measurements are taken at a plurality of slice locations. Next, a series of reference locations are selected which are spaced apart in the machine direction along the sheet surface and then, for selected slices, measurement values are estimated based upon the actual measurements at locations on the selected slices. In the preferred embodiment, generally linear relationships are determined between at least two measurements actually made on each slice, and then measurement values are estimated based on the linear relationships by interpolation and extrapolation.

DETAILED DESCRIPTION OF THE PREFEERRED EMBODIMENT

Figure 1:
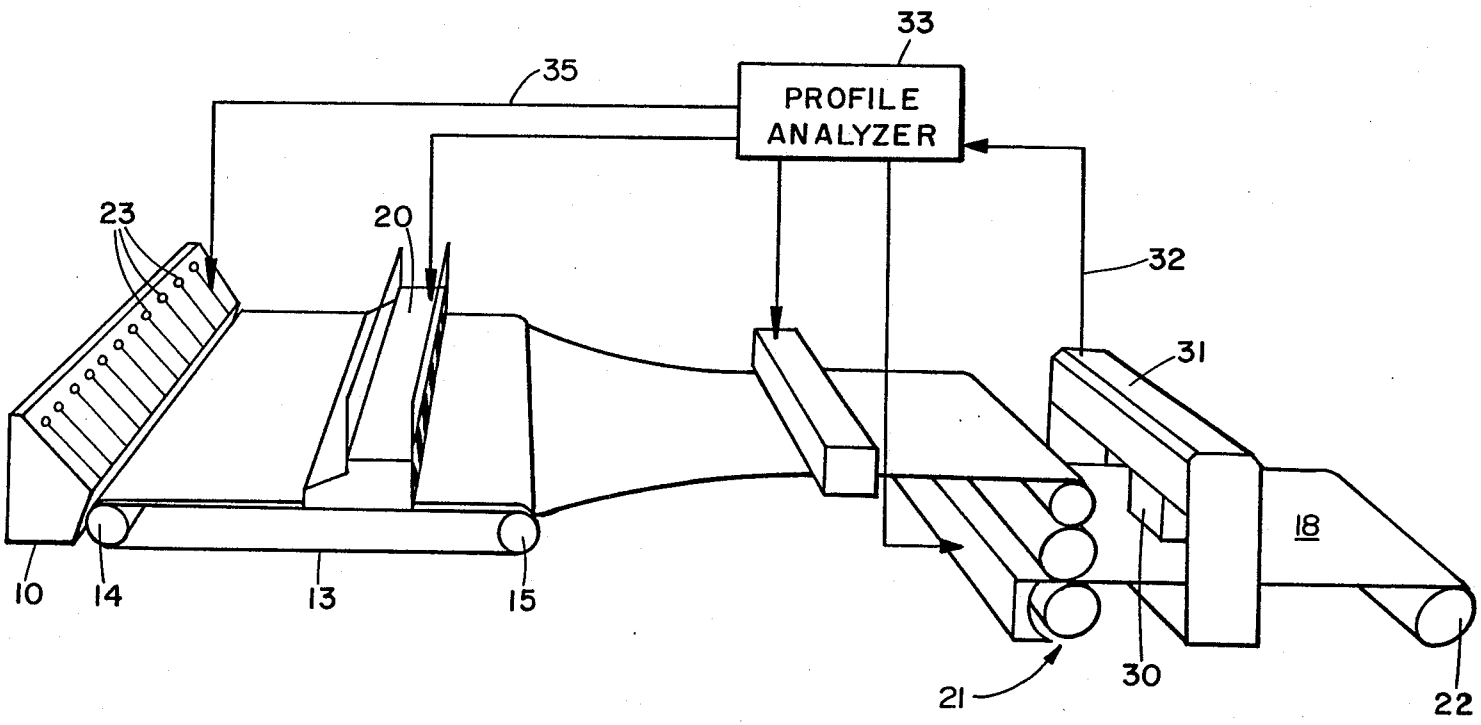
FIG. 1 is a generally schematic view of a sheetmaking machine.

FIG. 1 generally shows a typical sheetmaking machine for producing continuous sheet material such as paper or plastic. In the illustrated embodiment, the sheetmaking machine includes a feed box 10 mounted to discharge raw material onto a supporting web 13 trained between rollers 14 and 15. The sheetmaking machine also includes processing stages, such as a steambox 20 and a calendaring device 21, which operate upon the raw material to produce a finished sheet 18 which is collected by a reel 22.

It should be understood that such processing stages each include devices, called profile actuators, that control properties across sheet 18. In practice, the profile actuators provide generally independent adjustment at adjacent cross-directional locations, normally referred to as "slices". For instance, steam box 20 can be understood to include actuators that control the quantity of steam applied to sheet 18 at various slice locations. Also, calendaring stage 21 can be understood to include actuators for controlling the pressure applied to sheet 18 at various slice locations.

To provide control information for the profile actuators, at least one scanning sensor 30 is provided on the sheetmaking machine to measure a selected sheet property such as, for example, caliper or basis weight in the case of papermaking. In the illustrated embodiment, scanning sensor 30 is mounted on a supporting frame 31 to be driven to periodically traverse the sheetmaking machine in the cross direction. Normally, the scanning sensor moves periodically across the sheetmaking machine, but the scanning period can be somewhat irregular in practice. Further, scanning sensor 30 is connected, as by line 32, to a profile analyzer 33 to provide the analyzer with signals indicative of the measured sheet property. From profile analyzer 33, control signals are provided to the profile actuators at one or more of the processing stages; for example, line 35 carries control signals from profile analyzer 33 to profile actuators 23 on feedbox 10.

Because of the velocity of sheet 18, scanning sensor 30 does not measure the selected sheet property at locations which are aligned across the surface of sheet 18 exactly perpendicular to the longitudinal edge of the sheet (i.e., in the true cross-directional). Instead, as mentioned above, the actual cross-directional measurement locations are located along paths on the sheet surface which are skewed, or biased, with respect to the direction exactly perpendicular to the sheet edge.

Figures 2A, 2B:
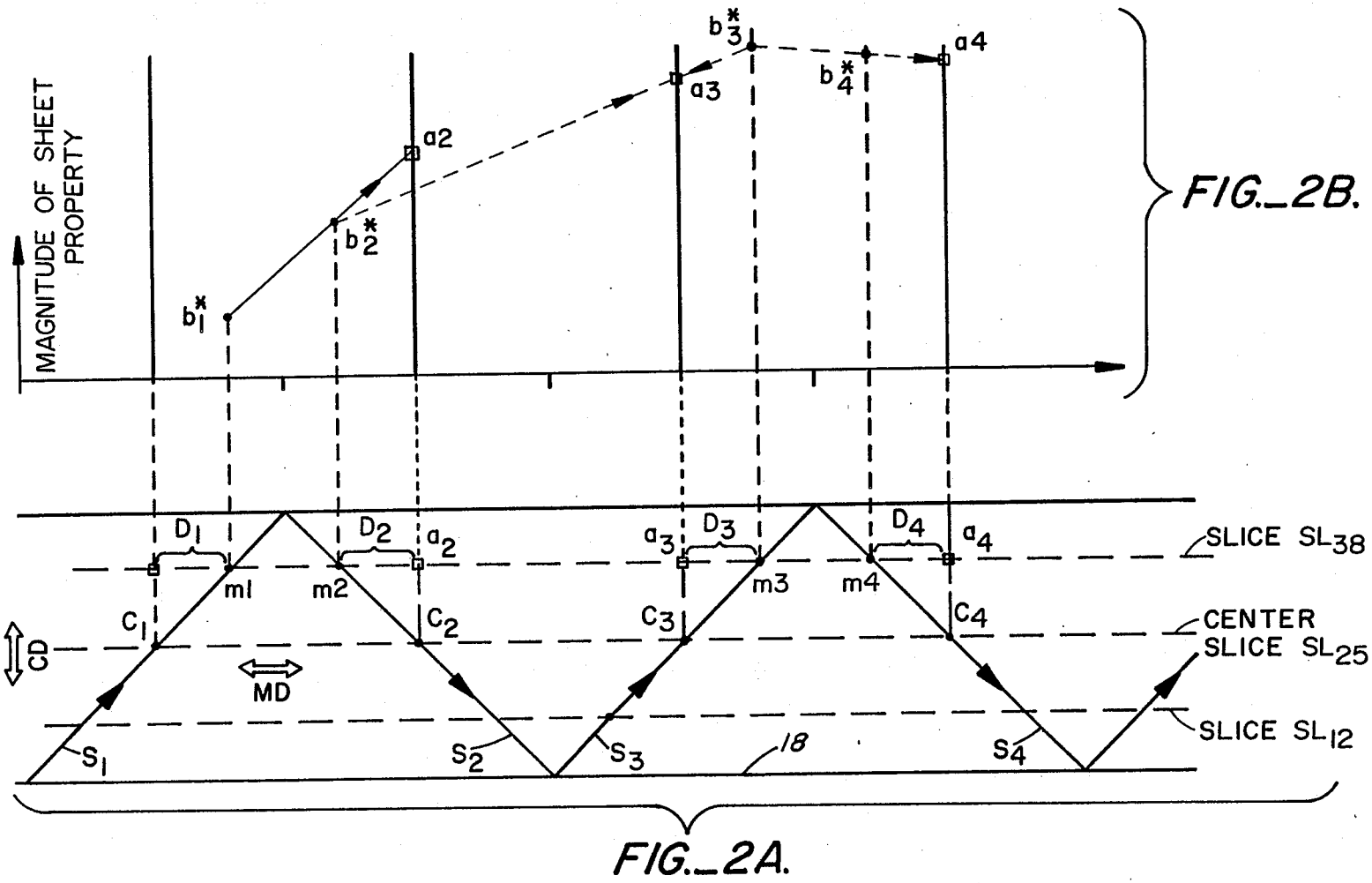
FIG. 2A shows an example of a path that a scanning sensor follows over a moving sheet.
FIG. 2B is a graph that shows measured and estimated values of sheet properties for the scanning path of FIG. 2A.

FIG. 2A shows an example of the pattern of cross-directional measurement points across the surface of sheet 18. More particularly, the zig-zagging solid line in FIG. 2A shows the actual pattern of measurement points that would be traced by scanning sensor 30 on the surface of sheet 18 for back-and-forth consecutive scanning paths $S_1$, $S_2$, $S_3$, and so forth as sheet 18 travels in the machine direction (MD). It may be appreciated that the angle of each of the actual scanning paths relative to the true cross-direction (CD) depends upon the cross-directional velocity of scanning sensor 30 and upon the machine-direction velocity of sheet 18. (The angle of each of the scanning paths across sheet 18 also depends upon the orientation of frame 31 relative to the sheetmaking machine; in practice, however, the frame orientation is not variable during normal sheetmaking operations.) In the ideal case, cross-directional measurements would be made instantaneously across the sheet and the scanning paths would be parallel lines in the true cross-direction (i.e., exactly perpendicular to the sheet edge). In practice, however, actual scanning paths have the zig-zag pattern shown in FIG. 2A and, moreover, there are occasional lags between the time a sensor reaches an edge of a sheet and the time at which the return scan begins.

For purposes of explanation, sheet 18 in FIG. 2A is shown as divided into a series of longitudinally-extending parallel strips, referred to above as slices. It can be assumed that slice $SL_{25}$ is midway between the edges of the sheet, that slice $SL_{38}$ is close to the far edge of sheet 18, and that $SL_{12}$ is close to the near edge. The points $c_1$, $c_2$, $c_3$ and so forth along center slice $SL_{25}$ indicate for purposes of this example, the points at which measurements are taken by scanning sensor 30 as it regularly traverses back and forth sheet 18 at generally constant speed. The points $m_1$, $m_2$, $m_3$ and so forth indicate points at which measurements are taken by scanning sensor 30 as it traverses across slice $SL_{38}$. Further in the example shown in FIG. 2A, ther are time lags between the time the scanning sensor reaches the edge of sheet 18 and the time the return scans begin.

As is evident from FIG. 2A, the measurement points $c_1$, $c_2$ and so forth along center slice $SL_{25}$ are evenly spaced in the machine direction, but measurement points $m_1$, $m_2$ and so forth along off-center slice $SL_{38}$ are not evenly spaced. The same is true of all other off-center slices. Thus, measurements along off-center slices are either taken before, or after, measuements taken along the center slice. In FIG. 2A, the longitudinal spacing between measurement points $m_1$ and $c_1$ is represented by distance $D_1$, the longitudinal spacing between measurement points $m_2$ and $c_2$ is represented by distance $D_2$, and so forth. When scanning sensor 30 traverses a sheet at constant speed in both directions without lags at the sheet edges, $D_1=D_2=D_3$, and so forth.

Figure 3:
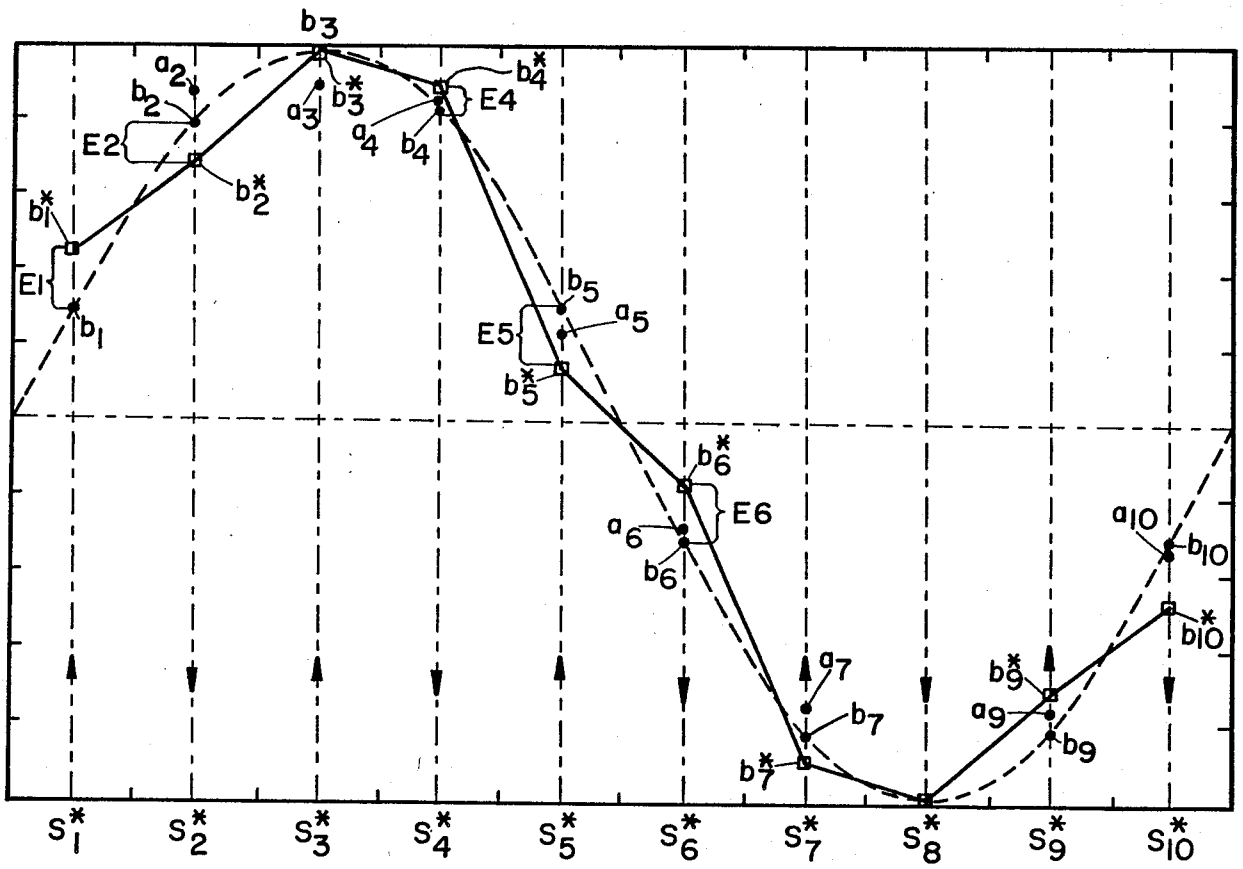
FIG. 3 is a graph that shows actual values of a sheet property together with measured values along a particular slice of the sheet.

FIG. 3 is the graph of the magnitude of a measurable sheet property, such as basis weight, at various locations along the length of sheet 18 for an off-center slice, say slice $SL_{38}$. (That is, the vertical axis in FIG. 3 represents the magnitude of a measurable sheet property and the horizontal axis represents positions along a sheet in the machine direction). In the graph of FIG. 3, the length of sheet 18 is divided by regularly spaced parallel lines $S_1$*, $S_2$*, and so forth. Those parallel lines indicate the locus of true, or instantaneous, cross-directional scans, each of which extends exactly perpendicular to the edge of sheet 18. In terms of FIG. 2A, the parallel lines $S_1$*, $S_2$* and so forth in FIG. 3 can be understood to correspond to the machine-directional locations at which respective measurement points $C_1$, $C_2$, $C_3$ and so forth are located.

For purposes of discussion of FIG. 3, it should be assumed that there is a measurable sheet property whose magnitude is indicated by the dashed curve and that this sheet property varies sinusoidally in the machine direction but is constant in the cross-direction. In other words, it should be assumed that, at any slice, the measured sheet property would be represented by the same curve relative to scans $S_1$*, $S_2$*, and so forth. In still other words, it should be assumed that the cross-directional profiles for the given sheet property are constant from slice to slice.

In FIG. 3, the points labelled $b_1$, $b_2$, and so forth indicate particular values of the measured sheet property for respective scans $S_1$*, $S_2$*, $S_3$* and so forth. (That is, a downwardly directed arrow in FIG. 3 indicates that the scanning direction is toward the near edge of sheet 18 and an upwardly directed arrow indicates that the scanning In other words, the values $b_1$, $b_2$ and so forth correspond to hypothetical values of the measured sheet property for true scans, that is, scans which extend exactly perpendicular to the edge of the sheet as if the scans were made while the sheet was stationary. $S_1$*, $S_2$* and so forth represent these true scans. The values $b_1$, $b_2$ and so forth differ from material to material, and their representation in FIG. 3 is solely to demonstrate examples of values which might be measured in a true scan; in view of the explanation provided below, it will be appreciated that the values $b_1$, $b_2$ and so forth have no bearing on the calculation of extrapolated or interpolated values. direction is toward the far edge of the sheet.) Points $b_1$*, $b_2$*, $b_3$* and so forth in FIG. 3 indicate the magnitude of actual measurements obtained on an off-center slice such as slice $SL_{38}$ by scanning sensor 30 during scans corresponding to $S_1$*, $S_2$* and so forth. Since scanning sensor 30 does not actually take measuements at slice $SL_{38}$ until either before, or after, taking measurements at center slice $SL_{25}$, the measurements $b_1$*, $b_2$*, and so forth are displaced in the machine direction either before, or after, the true cross-directional location of associated points $b_1$, $b_2$, and so forth. Furthermore, because of the displacements, the magnitude of each of the actually measured values $b_1$*, $b_2$*, and so forth differs from each of the corresponding values $b_1$, $b_2$ and so forth which would be obtained for true cross-directional scans. (For convenience in viewing FIG. 3, solid lines connect the measurement point b1*, b2* and so forth.)

Further in FIG. 3, the difference, or error, between the magnitude of the value $b_1$ for scan $S_1$ and the actually measured value $b_1$* is indicated as $E_1$. Likewise, the error between the magnitude of the value $b_2$ and the actually measured value $b_2$* for scan $S_2$ is indicated as $E_2$, and so forth.

Figure 4:
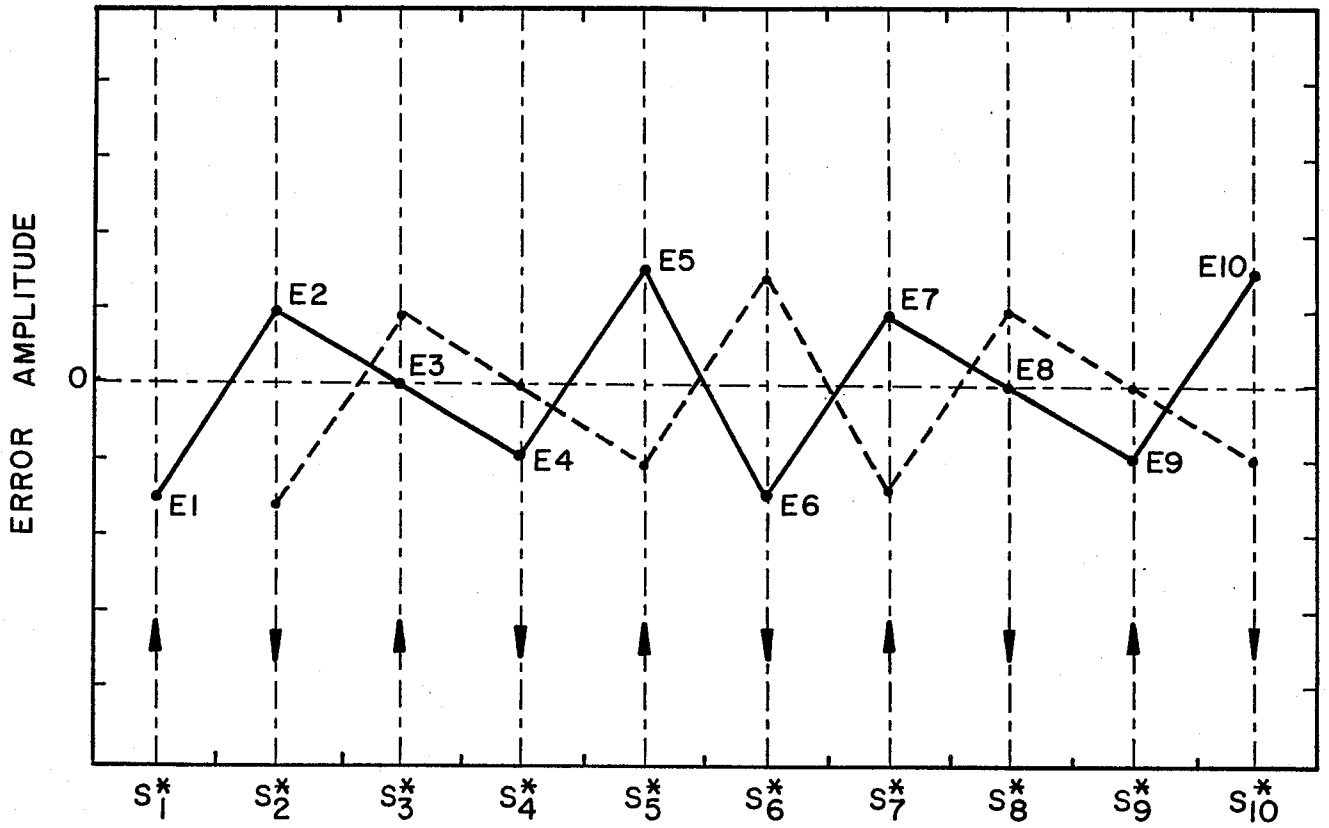
FIG. 4 is a graph which corresponds to FIG. 3 and which shows errors between actual and measured values of sheet properties.

FIG. 4 shows the magnitude of the errors $E_1$, $E_2$ and so forth for slice $SL_{38}$ in FIG. 3 plotted as a function of scan location. The dashed line in FIG. 4 indicates errors between measured and actual sheet properties for some other slice location. Thus, FIG. 4 illustrates that measurement errors can vary from slice to slice even when cross-directional profiles are constant between slices. In practice, the phase shift between measurement errors is not necessarily regular as shown in FIG. 3. In fact, measurement errors can vary both in magnitude and in frequency. In some cases, the measurement errors vary more slowly than actual machine-directional variations and, therefore, the measurement errors cannot be eliminated by frequency filtering. Moreover, averaging errors from profile to profile in such cases does not necessarily reduce the effect of the errors.

There will now be described a method for minimizing errors in profile measurements compiled while scanning sensor 30 traverses across sheet 18. More particularly, a method will be described wherein profile measurement errors are minimized by estimating measurements which would be made at regularly spaced intervals for ideal (i.e., instantaneous) scans in the cross direction. In practice, such alignments are usually made in relation to to measurements taken along the center slice of a sheet, since those measurements are normally spaced regularly in the machine direction.

FIG. 2B illustrates one example of a procedure for aligning cross-directional measurements from an off-center slice, such as $SL_{38}$, with corresponding measurements taken at the center slice $SL_{25}$. In FIG. 2B, values along the vertical axis represent the magnitude of a measured sheet property and values along the horizontal axis represent the machine-directional location along sheet 18 at which the measurements are taken. In this exemplary procedure, the values $b_1$* and $b_2$* of measurements taken at locations $m_1$ and $m_2$ are extrapolated linearly by extending a straight line between values $b_1$* and $b_2$* to arrive at an estimated value $a_2$ that approximates (i.e., estimates) the value of a measurement that would be obtained along slice $SL_{38}$ at the machine directional location of measurement point $c_2$. The estimated magnitude of measurement $a_2$ can be called an "aligned" value, since it represents the value of an estimated measurement at a point which is aligned in the true cross direction with the machine-directional location of center-slice measurement point $c_2$.

Simlarly, to determine an aligned measurement $a_3$ for scan $S_3$, the values $b_2$* and $b_3$* of measurements taken at locations $m_2$ and $m_3$ are linearly interpolated by extending a straight line between values $b_2$* and $b_3$*. The intersection of the interpolation line with the machine-directional coordinate for scan $S_3$ at center-slice measurement point C3 is determined and assigned value $a_3$.

The above-described procedure can also be carried out in terms of the values shown in FIG. 3. Thus, in FIG. 3, it can be observed that estimated measurements $a_2$, $a_3$, $a_4$ and so forth generally lie much closer to the true sheet profile values $b_2$, $b_3$ and so forth than actual measured values $b_2$*, $b_3$* and so forth. Thus, the above-described alignment method substantially increases the accuracy of cross-directional profiles.

In practice, estimated values for profile measurements are calculated for each slice by a microprocessor-based control system. In operation of the systems, the machine-directional coordinate for each aligned point is determined based upon the speed at which a sheet is travelling and the speed at which a scanning sensor traverses the sheet. Values for the speed of a sheet and scanning sensor can be readily determined by conventional speed sensors.

While the present invention has been illustrated and described in accordance with a preferred embodiment, it should be recognized that variations and changes may be made therein without departing from the invention as set forth in the following claims. For example, the preceding discussion focused upon the use of two actual measurement values for calculating each estimated value; however, three or more measurement values can be used as a basis for estimating profile values. Also, although linear extrapolations and interpolations are the most convenient to make, estimated values can also be calculated based upon non-linear estimation functions.

What is claimed is:

1. A method for determining measurements of a property of travelling sheet materials during production, wherein the reference locations are generally regularly spaced apart, comprising the steps of:

repeatedly traversing a travelling sheet with a scanning sensor and, during each traverse, taking measurements of a property of the sheet at a plurality of slice locations;

selecting a series of reference locations which are spaced apart in the machine direction along the sheet surface;

then, for selected slices, estimating measurement values at locations on the selected slices which are not spaced in the machine direction at the same spacing as the reference locations.

2. The method of claim 1, wherein said estimating step includes estimating a measurement for a selected slice based upon actual measurements at the slice taken during two traverses of the slice.

3. The method of claim 2, wherein said measurements taken during consecutive traverses are linearly extrapolated to determine estimated measurements.

4. The method of claim 2, wherein said meaurements taken during consecutive traverses are linearly interpolated to determine the actual measurement.

5. The method of claim 1, wherein the estimating step includes:

for each of the selected slices, determining a generally linear relationship between at least two measurements actually made on the slice; and estimating a measurement value based on said generally linear relationship for a selected reference location.

6. The method of claim 1, wherein the measured property is the basis weight of the sheet.

7. The method of claim 1, wherein the measured property is the moisture content of the sheet.

8. The method of claim 1, wherein the measured property is the caliper of the sheet.

9. The method of claim 1, wherein the sheet material is paper.

10. The method of claim 1, wherein the sheet material is plastic.

11. A method of determining measurements of a property of continuous sheet material during production, wherein the reference locations are generally regularly spaced apart, comprising the steps of:

repeatedly traversing a travelling sheet from edge to edge with a scanning sensor;

during each traverse, taking measurements of a property of the sheet at selected slice locations;

for each traverse, selecting a reference machine-direction location which is generally regularly spaced relative to precedingly-selected machine-directional locations;

estimating measured values of the sheet property at the selected slices based upon measurements actually taken at the slices at locations which are generally regularly spaced in the machine-direction.

12. The method of claim 11, wherein the estimating step includes:

for each of the selected slices, determining a generally linear relationship between at least two measurements actually made on the slice; and estimating a measurement value based on said generally linear relationship for a selected reference location.

13. The method of claim 11, wherein the measured property is the basis weight of the sheet.

14. The method of claim 11, wherein the measured property is the moisture content of the sheet.

15. The method of claim 11, wherein the measured property is the caliper of the sheet.

16. The method of claim 11, wherein the sheet material is paper.

17. The method of claim 11, wherein the sheet material is plastic.

18. A method for determining measurements of a property of a travelling sheet during production, wherein the reference locations are generally regularly spaced apart, comprising the steps of:

repeatedly traversing a travelling sheet with a scanning sensor and, during each traverse, taking measurements of a property of a sheet at a plurality of slice locations;

selecting a series of reference locations which are spaced apart in the machine direction along the sheet surface;

for each of the selected slices, determining generally linear relationships between at least two measurements actually made on the slice; and estimating measurement values based on said generally linear relationship for selected reference locations.

19. The method of claim 18, wherein measurements taken during back and forth consecutive trverses are linearly extrapolated to determine estimated measurements.

20. The method of claim 18, also including the step of linearly interpolating measurements taken during consecutive traverses to determine the actual measurement.

* * * * *